US008517089B2

(12) United States Patent
Galle et al.

(10) Patent No.: US 8,517,089 B2
(45) Date of Patent: Aug. 27, 2013

(54) CASING HANGER PROFILE FOR MULTIPLE SEAL LANDING POSITIONS

(75) Inventors: Gary Galle, Houston, TX (US); Nicholas P. Gette, Houston, TX (US); Ryan Herbel, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 296 days.

(21) Appl. No.: 12/837,866

(22) Filed: Jul. 16, 2010

(65) Prior Publication Data

US 2012/0012336 A1 Jan. 19, 2012

(51) Int. Cl.
*E21B 33/03* (2006.01)

(52) U.S. Cl.
USPC ..... 166/75.13; 166/75.14; 166/88.3; 166/368

(58) Field of Classification Search
USPC ..... 166/379, 368, 89.1, 75.13, 75.14
See application file for complete search history.

(56) References Cited

U.S. PATENT DOCUMENTS

| | | | | |
|---|---|---|---|---|
| 4,665,979 | A * | 5/1987 | Boehm, Jr. | 166/208 |
| 4,842,307 | A | 6/1989 | Sweeney et al. | |
| 4,932,472 | A | 6/1990 | Boehm, Jr. | |
| 4,978,147 | A * | 12/1990 | Henderson et al. | 285/2 |
| 5,067,734 | A * | 11/1991 | Boehm, Jr. | 277/328 |
| 5,199,495 | A * | 4/1993 | Brammer et al. | 166/339 |
| 5,285,853 | A | 2/1994 | Eckert et al. | |
| 5,360,063 | A * | 11/1994 | Henderson, Jr. | 166/208 |
| 5,456,314 | A | 10/1995 | Boehm, Jr. et al. | |
| 7,040,412 | B2 * | 5/2006 | DeBerry | 166/382 |
| 7,762,319 | B2 * | 7/2010 | Nelson | 166/84.1 |
| 7,861,789 | B2 * | 1/2011 | Nelson | 166/348 |
| 8,146,670 | B2 * | 4/2012 | Ellis et al. | 166/379 |
| 8,186,426 | B2 * | 5/2012 | Nelson | 166/88.3 |
| 8,205,670 | B2 * | 6/2012 | Nelson | 166/84.1 |
| 2002/0121368 | A1 | 9/2002 | Radi | |
| 2006/0191680 | A1 * | 8/2006 | Nelson | 166/208 |
| 2010/0116489 | A1 | 5/2010 | Nelson | |
| 2010/0126736 | A1 * | 5/2010 | Ellis et al. | 166/387 |
| 2010/0147533 | A1 * | 6/2010 | Nelson | 166/379 |
| 2012/0012336 | A1 * | 1/2012 | Galle et al. | 166/379 |

FOREIGN PATENT DOCUMENTS

| | | |
|---|---|---|
| EP | 2314828 A2 | 4/2011 |
| GB | 2180016 A | 3/1987 |
| GB | 2244502 A | 12/1991 |

OTHER PUBLICATIONS

GB Search Report issued Oct. 28, 2011 in corresponding Application No. GB1111972.4.

GB Partial Search Report dated Sep. 27, 2011 corresponding to Application No. GB1111972.4.

* cited by examiner

*Primary Examiner* — Jennifer H Gay
(74) *Attorney, Agent, or Firm* — Bracewell & Giuliani LLP

(57) ABSTRACT

A wellhead assembly having a wellhead housing, a casing hanger set within the wellhead housing, and sealing areas provided on opposing surfaces of the wellhead housing and casing hanger. The sealing areas circumscribe an axis of the wellhead assembly along respective axial distances on the wellhead housing and casing hanger. A seal is included with the wellhead assembly that has inner and outer legs that respectively engage the sealing areas and form sealing surfaces against the sealing areas. The axial distances of the sealing areas exceeds the length of the inner and outer legs, so that an original seal can be removed and replaced by a secondary seal, wherein the secondary seal engages sealing areas different from the sealing areas engaged by the original seal.

27 Claims, 4 Drawing Sheets

CASING HANGER PROFILE FOR MULTIPLE SEAL LANDING POSITIONS

1. FIELD OF THE INVENTION

This invention relates in general to production of oil and gas wells, and in particular to a wellhead assembly having a casing hanger profiled to accommodate multiple locations for contacting a sealing assembly.

2. DESCRIPTION OF RELATED ART

Wellheads used in the production of hydrocarbons extracted from subterranean formations typically comprise a wellhead assembly attached at the upper end of a wellbore formed into a hydrocarbon producing formation. An annular wellhead housing typically makes up the outermost member where wellhead assemblies connect to a wellbore. A production tree usually connects to the upper end of a wellhead assembly for controlling flow in and out of the wellbore and allowing access into the wellbore. Support hangers are generally included within the wellhead housing for suspending production tubing and casing into the wellbore. The casing lines the wellbore, thereby isolating the wellbore from the surrounding formation. The tubing typically lies concentric within the casing and provides a conduit therein for producing the hydrocarbons entrained within the formation.

Annular spaces within concentric members, such as the wellhead housing and casing hanger, may be exposed to high pressures downhole that require isolation from within the wellhead housing and/or production tree. One manner of isolation involves setting seals within the annular spaces to form a pressure barrier between the downhole pressure and ambient to the wellhead housing.

SUMMARY OF THE INVENTION

Disclosed herein is a wellhead assembly, in an example embodiment the wellhead assembly includes an annular inner member with a curved outer surface and a series of sealing areas on the outer surface. The sealing areas are spaced along an axial length of the annular inner member to define an outer sealing area distance. The example embodiment of the wellhead assembly also includes an annular outer member around the inner member; the outer member has a curved inner surface lined with a series of sealing areas along an inner axial distance of the inner surface. The inner sealing areas face the outer sealing areas and an annular space is defined between the outer member and the inner member. Also in the example embodiment of the wellhead assembly, a seal is in the annular space and includes an annular outer leg and an annular inner leg. The inner leg has a sealing surface in sealing contact with the outer grooves, the inner leg also has a length of no more than about one-half the distance of the outer grooves. In an optional embodiment, the inner sealing areas can be arranged axially along the outer annular member to define an outer sealing area distance. The outer leg also has a sealing surface, that in an embodiment is no more than about one-half the outer sealing area distance. In one example embodiment, the sealing surface of the outer leg is in sealing contact with the sealing areas. The outer annular member can be a wellhead housing and the inner annular member can be a casing hanger. An energizing ring can be included in an example embodiment of the wellhead assembly, wherein the energizing ring is selectively inserted between the inner and outer legs for urging the inner and outer legs respectively into sealing contact with the inner and outer sealing areas.

In another example embodiment, disclosed herein is a wellhead assembly having an axis, an outer annular member around the axis and an inner annular member inserted into the outer annular member to form an annular space. Outer sealing areas can be included on an inner surface of the outer annular member that circumscribe the axis along an outer axial distance. Also included can be inner sealing areas formed on a portion of an outer surface of the inner annular member that circumscribe the axis along an inner axial distance. A seal can be set in the space that includes an annular inner leg with a sealing surface in sealing contact with the inner sealing areas, where the sealing contact is along a distance no more than about one-half the inner axial distance. The seal can also include an annular outer leg with a sealing surface in sealing contact with the outer sealing areas along a distance no more than about one-half the outer axial distance. In an example embodiment, the inner and outer legs are disposed a radial distance apart and connected by a base. An energizing ring can be included with the wellhead assembly, where the energizing ring is selectively inserted between the inner and outer legs for urging the inner and outer legs respectively into sealing contact with the inner and outer sealing areas. In an example embodiment, the inner sealing areas make up part of a first sealing surface, and wherein a second sealing surface is provided along a portion of the outer surface of the inner annular member having a larger diameter than the portion of the inner annular member having the inner sealing areas. In an example embodiment, the inner leg extends up to about one-third of the length of the inner axial distance. In an example embodiment, the outer annular member is a wellhead housing and the inner annular member is a casing hanger.

Yet further disclosed herein is a method of assembling a wellhead assembly. In an example embodiment the method includes providing an outer annular member with a curved inner surface and a series of inner sealing areas formed on a portion of the inner surface and providing an inner annular member with a curved outer surface and a series of outer sealing areas around a portion of the outer surface. The outer sealing areas of the example embodiment are spaced along an axial length of the inner annular member to define an outer sealing area distance. The method of the example embodiment further includes inserting the inner annular member into the outer annular member so that the inner sealing areas face the outer sealing areas and define an annular space between the outer annular member and the inner annular member. A seal is provide that includes an annular outer leg and an annular inner leg having a sealing surface that extends no more than about one-half the inner axial distance; and the seal is set into the annular space. The space between the inner and outer annular members can be sealed by urging a portion of the sealing surface of the inner leg radially inward against a segment of the outer sealing areas. In an alternate embodiment, the inner sealing areas can be arranged axially along the outer annular member to define an outer sealing area distance and wherein the outer leg has a sealing surface no more than about one-half the outer sealing area distance. Optionally, the method of the example embodiment can further include urging the sealing surface of the outer leg radially outward against the outer sealing areas. In an alternative, the seal can be removed from the space and another seal inserted a different axial location within the space. The other seal can be a secondary seal. The segment can be deemed a first segment and the method can further include sealing between the inner and outer annular members by urging a portion of the sealing surface of the inner leg radially inward against a second segment that is axially spaced from the first segment. In an optional embodiment, an area on the outer surface of the inner annular member adjacent the outer sealing area distance is substantially planar; in this embodiment the method can further include urging a portion of the sealing surface of the inner leg radially inward against the substantially planar area. The outer annular member can be a wellhead housing and the inner annular member can be a casing hanger.

DETAILED DESCRIPTION OF THE INVENTION

Figure 1:
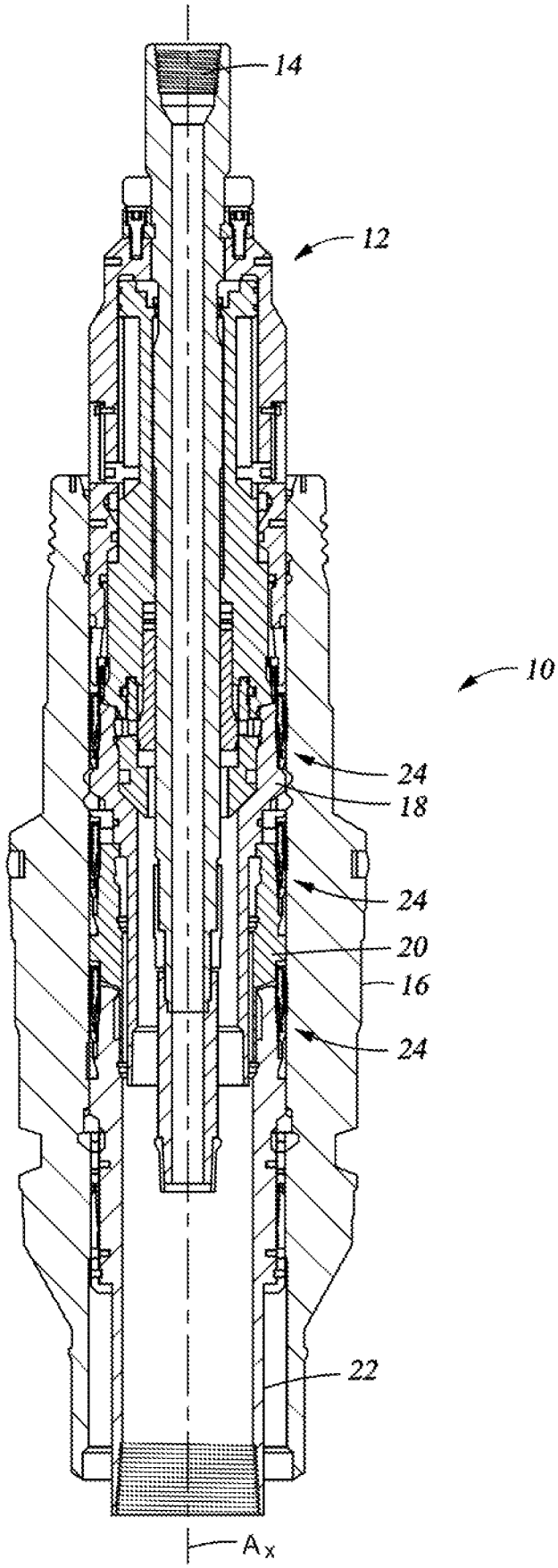
FIG. 1 is a side sectional view of a wellhead assembly in accordance with the present disclosure.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Illustrated in a side sectional view in FIG. 1 is one example of a wellhead assembly 10 and a running tool 12 inserted in the wellhead assembly 10. The running tool 12 includes an inner mandrel 14, having a threaded upper end for connection to a raising and/or lowering device, such as a drill pipe (not shown). The drill pipe, which in an example depends downward from a drilling platform (not shown), can be used for raising, lowering, and operating the running tool 12. The wellhead assembly 10 of FIG. 1 includes an outer annular wellhead housing 16, also referred to as a high pressure housing. The running tool 12 is shown landing a casing hanger 18 within the wellhead housing 16. After landing the casing hanger 18 in the wellhead housing 16, an annular space is formed between respective portions of the easing hanger 18 and wellhead housing 16. Additional hangers of similar configurations are illustrated coaxially within the wellhead housing 16 and below the casing hanger 18. The additional hangers include, a bridging hanger 20 and another casing hanger 22 beneath the bridging hanger 20. Seal assemblies 24 are illustrated set in the annular spaces between each of the hangers 18, 20, 22 and the wellhead housing 16.

Figure 2:
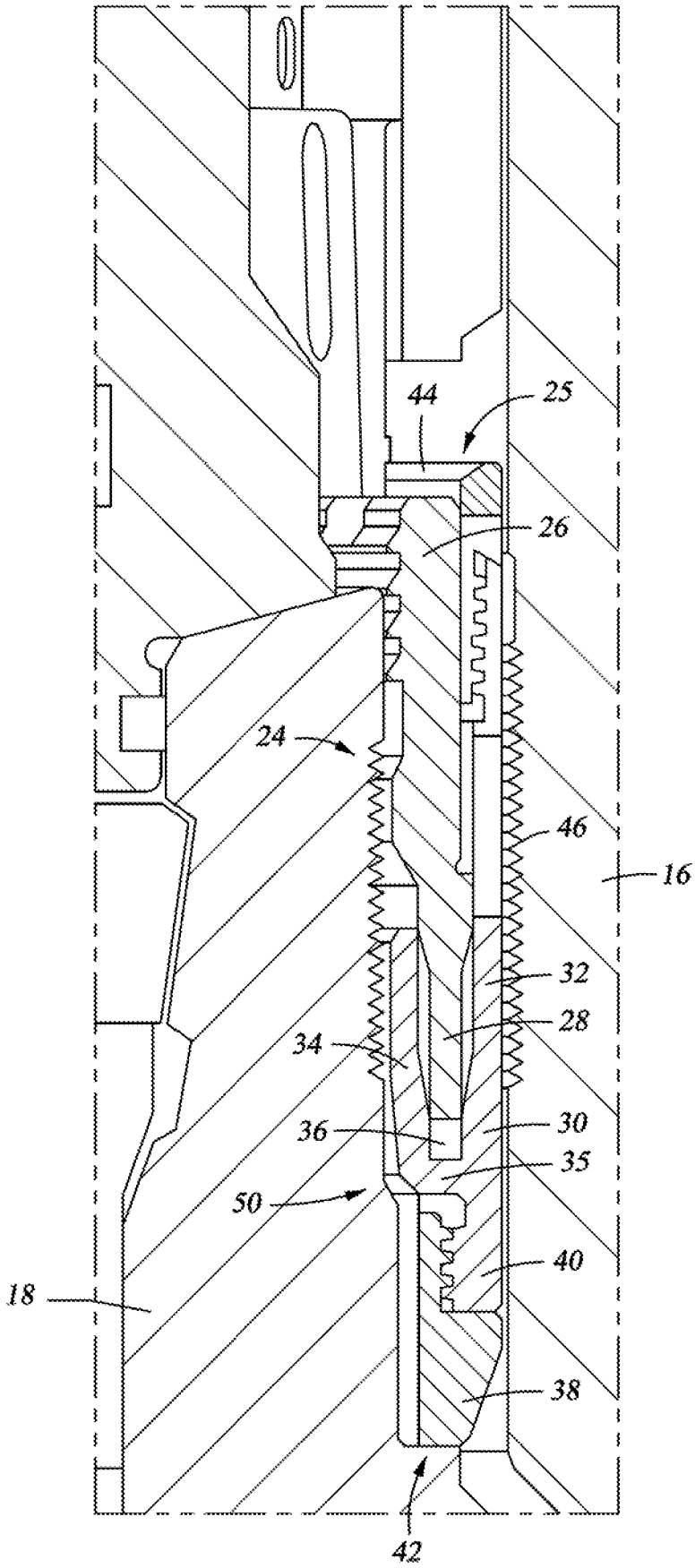
FIG. 2 is an enlarged view of a portion of the wellhead assembly of FIG. 1 that depicts an embodiment of a seal.

One example of the interface between an embodiment of the casing hanger 18 and wellhead housing 16 is shown in a side sectional view in FIG. 2. In the example of FIG. 2, the seal assembly 24 is set into an annular space 25 defined between the casing hanger 18 and wellhead housing 16. It should be pointed out that the seal assembly 24 is not limited to sealing between the casing hanger 18 and wellhead housing 16 but can include the bridging hanger 20 and casing hanger 22. An annular energizing ring 26 is shown inserted within the seal assembly 24 and used for downwardly urging the seal assembly 24 and into sealing engagement with respecting opposing surfaces of the wellhead housing 16 and casing hanger 18. The energizer ring 26 includes a lower end 28, shown as having a generally rectangular cross-section.

The seal assembly 24 includes a seal member 30 having an outer leg 32 and an inner leg 34 connected together by a base member 35 that attaches between the respective lower ends of the outer and inner legs 32, 34. Both the outer and inner legs 32, 34 are annular members each having a cross section with an elongated side generally parallel with an axis $A_x$ of the wellhead housing 10. The orientation of the legs 32, 34 and base member 35 form an annular slot 36 between the legs 32, 34 in which the lower end 28 of the energizing ring 26 is shown being inserted. Beneath the base 35, the seal assembly further includes an annular lower retainer 38. An upper portion of the lower retainer 38 threadingly engages the seal member 30 along a lower base 40. A lowermost surface of the lower retainer 38 is shown landed on a shoulder 42 shown provided on an outer diameter of the casing hanger 18. The shoulder 42 of FIG. 2 is generally perpendicular to the axis $A_X$ of the wellhead assembly 10. An optional retainer 44 circumscribes the outer periphery of the energizing ring 26 and in the space between the energizing ring 26 and inner surface of the wellhead housing 16.

Still referring to FIG. 2, a series of grooves or wickers 46 are shown formed respectively along an axial length of the inner surface of the wellhead housing 16 and the outer surface of the casing hanger 18. The wickers 46 illustrated are a series of adjacent grooves with a V-shaped cross-section. The respective axial lengths of the wickers 46 on the casing hanger 18 and wellhead housing 16 may or may not have the same distance. A sealing surface is provided on the outer leg 32 on the side facing the wellhead housing 16. Similarly, a sealing surface is provided on the inner leg 34 on a side facing the casing hanger 18. Urging the legs 32, 34 against the wickers 46 so that the legs 32, 34 deform from engagement with the wickers 46 creates a pressure barrier in the annular space 25. Also included in the embodiment of FIG. 2 is a taper 50 illustrated on the outer diameter of the casing hanger 18 and along a space between the lower terminal end of the wickers 46 on the casing hanger 18 and the shoulder 42.

Figure 3:
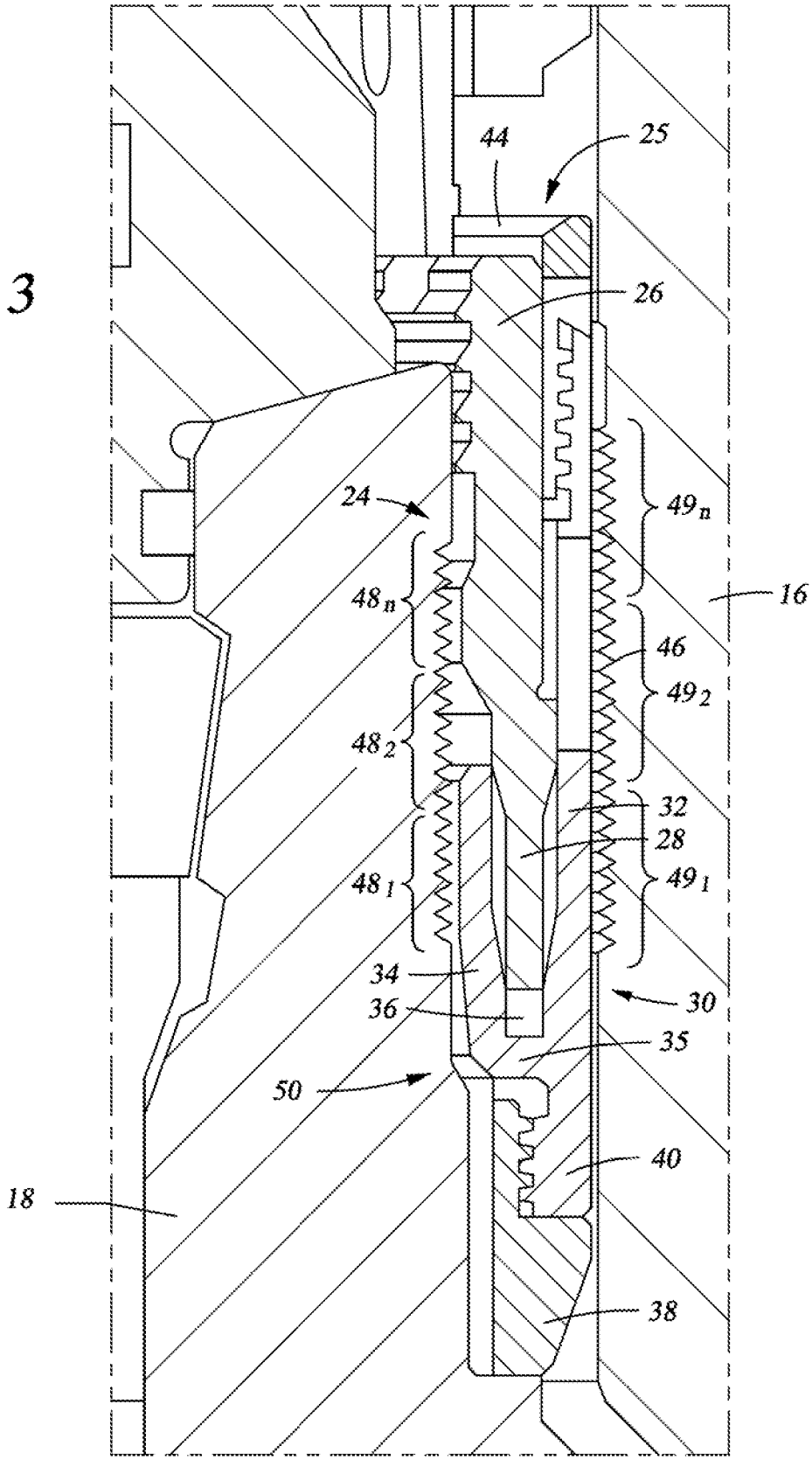
FIG. 3 is an illustration of the wellhead assembly of FIG. 2 with the seal in sealing engagement.

An example of setting the seal member 30 into sealing contact is illustrated in a side sectional view in FIG. 3. In this example, the energizing ring 26 is downwardly urged to insert the lower end 28 towards the lower portion of the annular slot 36; the lower end 28 pushes the legs 32, 34 in oppositely oriented directions and into engagement with the profiled surface (wickers 46) of the casing hanger 18 and wellhead housing 16. In the example of FIG. 3, the seal element 30 is made from a material, such as a metal, softer than the material of either the casing hanger 18 or wellhead housing 16. This causes the seal element 30 to deform in response to pressured contact with the wickered surface. The corresponding or resulting interface between the respective outer surfaces of the legs 32, 34 and wickers 46 on the casing hanger 18 and wellhead housing 16 form pressure seals to isolate wellbore pressure from the region above the seal assembly 24.

In the embodiment of FIG. 3, the axial distance of the wickers 46 can exceed the corresponding axial distance of the sealing surface of either leg 32, 34 to provide for multiple seal landing locations at different axial locations. For example, the axial distance occupied by the inner leg 34 of the total wickered distance of the casing hanger 18 is referred to as a landing zone $\mathbf{48}_1$ wherein additional landing zones $\mathbf{48}_2 \ldots \mathbf{48}_N$ may be provided. The axial distance of the wickers 46 on the wellhead housing 16 can also provide for multiple landing zones for engagement with a sealing surface on the outer leg 32, as illustrated by landing zones $\mathbf{49}_1, \mathbf{49}_2 \ldots \mathbf{49}_N$. Example distance ratios between the axial length of the wickers 46 (on either the casing hanger 18 or wellhead housing 16) and the legs 32, 34 can be about 1:1, 2:1:3:1, 4:1, 5:1 and greater. The distance ratios can also include fractional values. Multiple landing zones can be beneficial when a first or primary seal is set into the annular space for sealing between the casing hanger 18 and wellhead housing 16, but due to debris on the wickers 46, or damage to the wickers 46 or seal element 30, a pressure seal can not be maintained.

Figure 4:
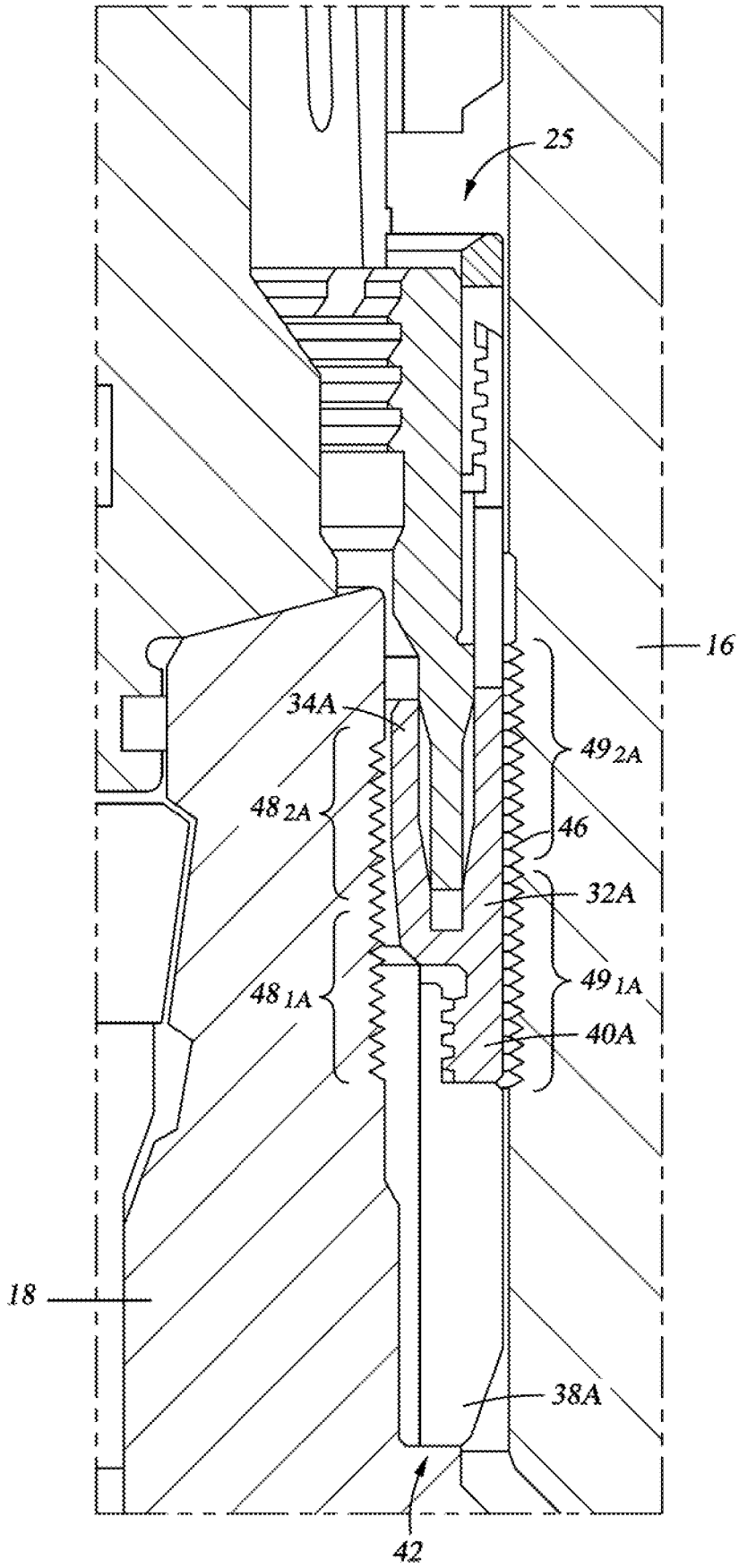
FIG. 4 is an illustration of an alternate embodiment of the seal of FIG. 2.

In an example of a damaged primary seal, such as shown in FIG. 4, a secondary seal assembly 24A may be inserted within the annular space 25 to provide sealing between the casing hanger 18 and wellhead housing 16. In the embodiment of FIG. 4, a sealing surface of an inner leg 34A is set adjacent wickers 46 to define a landing zone $\mathbf{48}_{2A}$, that is above and distinct from the wickers 46 in a landing zone $\mathbf{48}_{1A}$. This allows a second or secondary seal to be installed without being placed against damaged or debris-laden wickers 46. The extra length of the wickers 46 facilitates placement of the seal element 30A so that the legs 32A, 34A can engage previously unengaged wickers 46. This can be illustrated by the base 40A now in sealing contact with the wickers 46 on the wellhead housing 16 to define a landing zone $\mathbf{49}_{1A}$ and the outer leg 34A in sealing contact with the wickers 46 to define a landing zone $\mathbf{49}_{2A}$. In the example of FIG. 4, a lower retainer or spacer 38A is provided longer than the lower retainer 42 of FIG. 2. A lower retainer 42A of a different length may be used to position the seal assembly 24A at different landing zones.

While the invention has been shown or described in only some of its forms, it should be apparent to those skilled in the art that it is not so limited, but is susceptible to various changes without departing from the scope of the invention. For example, in an alternative embodiment, a seal assembly (not shown) separate from the seal assembly 24, may be set within the annular space 25 and into engagement with the substantially planar surface shown between the wickered portion and the taper 50.

What is claimed is:

1. A wellhead assembly comprising:

an annular inner member having a curvilinear outer surface with a series of outer grooves that circumscribe a portion of the outer surface and are spaced along an axial length of the annular inner member to define an outer grooved distance;

an annular outer member circumscribing the inner member and having a curvilinear inner surface with a series of inner grooves formed on an inner axial distance of the inner surface so that the inner grooves face the outer grooves and thereby define an annular space between the outer member and the inner member; and a seal in the annular space and comprising an annular outer leg and an annular inner leg having a sealing surface in sealing contact with the outer grooves and extending no more than about one-half the outer grooved distance.

2. The wellhead assembly of claim 1, wherein the inner grooves are arranged axially along the outer annular member to define an inner grooved distance and wherein the outer leg has a sealing surface no more than about one-half the inner grooved distance.

3. The wellhead assembly of claim 2, wherein the sealing surface of the outer leg is in sealing contact with the inner grooves.

4. The wellhead assembly of claim 1, wherein the outer annular member comprises a wellhead housing.

5. The wellhead assembly of claim 1, wherein the inner annular member comprises a casing hanger.

6. The wellhead assembly of claim 1, further comprising an energizing ring selectively inserted between the inner and outer legs for urging the inner and outer legs respectively into sealing contact with the inner and outer grooves.

7. A wellhead assembly having an axis comprising:

an outer annular member circumscribing the axis;

an inner annular member within the outer annular member thereby defining an annular space between the outer annular member and the inner annular member;

outer grooves on an inner surface of the outer annular member that circumscribe the axis along an outer axial distance;

inner grooves formed on a portion of an outer surface of the inner annular member that circumscribe the axis along an inner axial distance; and a seal disposed in the space and comprising:

an annular inner leg having a sealing surface in sealing contact with the inner grooves along a distance no more than about one-half the inner axial distance; and an annular outer leg having a sealing surface in sealing contact with the outer grooves along a distance no more than about one-half the outer axial distance.

8. The wellhead assembly of claim 7, wherein the inner and outer legs are disposed a radial distance apart and connected by a base.

9. The wellhead assembly of claim 7, further comprising an energizing ring selectively inserted between the inner and outer legs for urging the inner and outer legs respectively into sealing contact with the inner and outer grooves.

10. The wellhead assembly of claim 7, wherein the inner grooves comprise a first sealing surface, and wherein a second sealing surface is provided along a portion of the outer surface of the inner annular member having a larger diameter than the portion of the inner annular member having the inner grooves.

11. The wellhead assembly of claim 7, wherein the inner leg extends up to about one-third of the length of the inner axial distance.

12. The wellhead assembly of claim 7, wherein the outer annular member comprises a wellhead housing.

13. The wellhead assembly of claim 7, wherein the inner annular member comprises a casing hanger.

14. A wellhead assembly, comprising:

a high pressure housing having a plurality of wickers on an inner bore;

a casing hanger having a plurality of wickers on an outer surface facing the plurality of wickers on the inner bore of the high pressure housing when the casing hanger is disposed within the high pressure housing;

a first seal for sealing an annulus between the casing hanger and the high pressure housing and a series of axially contiguous wickers on the inner bore of the high pressure housing that define a first landing zone against which the first seal selectively interfaces to form a seal when the first seal is landed on a shoulder of the casing hanger; and a second seal that selectively interfaces against a portion of the axially continuous wickers when the second annular seal is landed on the shoulder of the casing hanger to define a second landing zone that is axially spaced apart from the first landing zone.

15. The wellhead assembly as recited in claim 14, wherein the first seal comprises a first retainer ring coupled to the sealing portion of the first seal and configured to orient the sealing portion of the first seal between the first set of wickers on the inner bore of the high pressure housing and the first set of wickers on the outer surface of the casing hanger when the first seal is landed on the shoulder of the casing hanger.

16. The wellhead assembly as recited in claim 15, wherein the second seal comprises a second retainer ring coupled to the sealing portion of the second seal and configured to orient the sealing portion of the second seal between the second set of wickers on the inner bore of the high pressure housing and the second set of wickers on the outer surface of the casing hanger when the second seal is landed on the shoulder of the casing hanger, the second retainer ring having a different height relative to the first retainer ring to position the sealing portion of the second seal at a different height in the wellhead assembly relative to the height that the first retainer ring positions the sealing portion of the first seal.

17. The wellhead assembly as recited in claim 16, wherein the lowest wicker of the second set of wickers of the high pressure housing and the casing hanger is at a greater height relative to the highest wicker in the first set of wickers of the high pressure housing and the casing hanger.

18. The wellhead assembly as recited in claim 17, wherein the sealing portion of the first seal has an inner leg and an outer leg separated by a gap and the first seal comprises an energizing ring adapted to urge the outer leg into engagement with the first set of wickers of the high pressure housing and the inner leg into engagement with the first set of wickers of the casing hanger when the energizing ring is driven into the gap.

19. The wellhead assembly as recited in claim 18, wherein the sealing portion of the second seal has an inner leg and an outer leg separated by a gap and the second seal comprises an energizing ring adapted to urge the outer leg into engagement with the second set of wickers of the high pressure housing and the inner leg into engagement with the second set of wickers of the casing hanger when the energizing ring is driven into the gap.

20. A family of seals for use in forming a seal in an annulus between a high pressure housing having at least one sealing surface on an inner bore and a casing hanger having at least one sealing surface on an outer surface opposite the at least one housing sealing region, comprising:

a primary seal, comprising a sealing portion and a first retainer ring coupled to the sealing portion, wherein the first retainer ring has a first height to orient the sealing portion of the first seal between a first sealing region of the at least one sealing surface on the inner bore of the high pressure housing and a first sealing region on the outer surface of the casing hanger when the primary seal is landed on a portion of the casing hanger; and a replacement seal, comprising a sealing portion and a second retainer ring coupled to the sealing portion, wherein the second retainer ring has a second height, different from the first height, to orient the sealing portion of the replacement seal between a second sealing region of the at least one sealing surface on the inner bore of the high pressure housing and a second sealing region on the outer surface of the casing hanger when the replacement seal is landed on the portion of the casing hanger, wherein the second height of the second retainer ring is selected so that the second sealing regions of the high pressure housing and the casing hanger are exclusive of the first sealing regions of the high pressure housing and the casing hanger.

21. The family of seals as recited in claim 20, wherein the at least one sealing surface of the high pressure housing comprises a plurality of wickers and the at least one sealing surface of the casing hanger comprises a plurality of wickers, the first retainer ring being configured to orient the sealing portion of the primary seal between a first set of wickers of the high pressure housing and the casing hanger, and the second retainer ring being configured to orient the sealing portion of the replacement seal between a second set of wickers of the high pressure housing and the casing hanger.

22. The family of seals as recited in claim 21, wherein the second height of the second retainer ring is great enough relative to the first height of the first retainer ring that the lowest wicker in the second set of wickers is above the highest wicker in the first set of wickers.

23. The family of seals as recited in claim 21, wherein the second height of the second retainer ring is low enough relative to the first height of the first retainer ring that the highest wicker in the second set of wickers is below the lowest wicker in the first set of wickers.

24. A wellhead assembly, comprising:

a high pressure housing having a contiguous housing sealing surface on an inner bore;

a casing hanger having a contiguous hanger sealing surface on an outer surface located opposite the housing sealing surface when the casing hanger is disposed within the high pressure housing;

a first seal having a radially inward facing surface in selective sealing engagement with a first portion of the hanger sealing surface when the first seal is landed on the casing hanger;

a second seal having a radially inward facing surface in selective sealing engagement with a second portion of the hanger sealing surface that is set axially apart from the first portion.

25. The wellhead assembly as recited in claim 24, wherein the second seal is configured so that the second sealing region of the high pressure housing is exclusive of the first sealing region of the high pressure housing.

26. The wellhead assembly as recited in claim 24, wherein the first seal comprises a first retainer ring coupled to the sealing portion of the first seal and configured to orient the sealing portion of the first seal between the first sealing region on the sealing surface on the inner bore of the high pressure housing and the first sealing region on the sealing surface on the outer surface of the casing hanger when the first seal is landed on the casing hanger.

27. The wellhead assembly as recited in claim 26, wherein the second seal comprises a second retainer ring coupled to the sealing portion of the second seal, the second retainer ring having a height selected to orient the sealing portion of the second seal between the second sealing region on the sealing surface on the inner bore of the high pressure housing and the second sealing region on the sealing surface on the outer surface of the casing hanger when the second seal is landed on the casing hanger.

* * * * *